US006054095A

United States Patent [19]

Minato et al.

[11] Patent Number: 6,054,095

[45] Date of Patent: Apr. 25, 2000

[54] WIDTHWISE UNIFORM COOLING SYSTEM FOR STEEL STRIP IN CONTINUOUS STEEL STRIP HEAT TREATMENT STEP

[75] Inventors: Ken Minato; Yasuo Hamamoto; Shinichiro Tomino; Takuro Hosojima; Hiroo Ishibashi, all of Kimitsu, Japan

[73] Assignee: Nippon Steel Corporation, Tokyo, Japan

[21] Appl. No.: 09/000,105

[22] PCT Filed: May 23, 1997

[86] PCT No.: PCT/JP97/01743

§ 371 Date: Jan. 16, 1998

§ 102(e) Date: Jan. 16, 1998

[87] PCT Pub. No.: WO97/44498

PCT Pub. Date: Nov. 27, 1997

[30] Foreign Application Priority Data

| | | | |
|---|---|---|---|
| May 23, 1996 | [JP] | Japan | 8-150447 |
| May 23, 1996 | [JP] | Japan | 8-150448 |
| May 23, 1996 | [JP] | Japan | 8-150449 |
| May 23, 1996 | [JP] | Japan | 8-150450 |
| Aug. 26, 1996 | [JP] | Japan | 8-240970 |
| Aug. 26, 1996 | [JP] | Japan | 8-240971 |

[51] Int. Cl.[7] ..... C21D 9/573

[52] U.S. Cl. ..... 266/81; 266/46; 266/113; 266/114

[58] Field of Search ..... 266/111, 113, 266/114, 46, 90, 81, 87, 78; 148/661, 658; 62/374

[56] References Cited

U.S. PATENT DOCUMENTS 4,318,534 3/1982 Thome et al. ..... 266/113

FOREIGN PATENT DOCUMENTS

| | | |
|---|---|---|
| 3-68720 | 3/1991 | Japan . |
| 3-291329 | 12/1991 | Japan . |
| 8-13046 | 1/1996 | Japan . |
| 9-118932 | 5/1997 | Japan . |
| 9-118934 | 5/1997 | Japan . |

*Primary Examiner*—Scott Kastler
*Attorney, Agent, or Firm*—Kenyon & Kenyon

[57] ABSTRACT

The present invention is to provide a cooling system for cooling a strip in a vertical path of a continuous strip heat-treating process in which cooling nozzles are arranged in a width direction of a strip on the surfaces of cooling headers arranged closely opposed to both surfaces of the strip, and each cooling nozzle is inclined to both edge portions in the width direction of the strip by an inclination angle in such a manner that a center line of a jet of a cooling medium, which is jetted out from the cooling nozzle, is inclined with respect to a normal line at a position on the strip surface where the center line of the jet of the cooling medium crosses the strip.

8 Claims, 11 Drawing Sheets

WIDTHWISE UNIFORM COOLING SYSTEM FOR STEEL STRIP IN CONTINUOUS STEEL STRIP HEAT TREATMENT STEP

TECHNICAL FIELD

The present invention relates to a cooling system for cooling a strip uniformly in the width direction of the strip in a continuous strip heat-treating process.

BACKGROUND ART

Concerning a heat-treating apparatus in which a strip is continuously heat-treated, various types of heat-treating apparatus are conventionally proposed. FIG. 1 is an arrangement view showing an example of the continuous strip heat-treating line. As shown in the view, a strip 11 is rewound by a payoff reel 1 and passes through a cleaning unit 2. Then the strip 11 passes through a heating zone 3, soaking zone 4, first quenching zone 5, heat-recuperating zone 6, over-aging treating zone 7, and second cooling zone 8. After that, the strip 11 is sent to a rolling mill 9 and then coiled by a tension reel 10.

In order to cool the strip in the first quenching zone 5 and the second cooling zone 8 in the above continuous strip heat-treating line, various cooling methods are conventionally proposed. When a general classification is made of these conventional cooling methods, the following three cooling methods are provided: a method of cooling a strip when a cooled roller comes into contact with the strip (Japanese Unexamined Patent Publication No. 59-143028); a method of cooling a strip when a cooling medium is directly blown against the strip (Japanese Unexamined Patent Publication No. 57-67134); and a method of cooling a strip when the strip is dipped in a cooling medium (Japanese Unexamined Patent Publication No. 54-162614).

In general, when the cooling zone is devised, these cooling methods are used singly or, alternatively, these cooling methods are used in combination with each other.

Next, referring to an example, the cooling method of cooling a strip by directly blowing a cooling medium against the strip will be explained as follows.

FIG. 2 is a cross-sectional view of the second cooling zone 8 taken on line X—X in FIG. 1. In this view, there is shown a means for cooling a strip by directly blowing a cooling medium against the strip. In the conventional cooling zone, the strip 11 is cooled as follows. The strip 11 is regarded as a flat shape, and cooling headers 12 are arranged in parallel with this flat strip 11. On the cooling headers 12, which are arranged in parallel with the strip, there are provided a plurality of cooling nozzles 13 which protrude perpendicularly to the cooling headers 12, and a cooling medium 14 is directly blown from the plurality of cooling nozzles 13 against the strip 11 so as cool the strip.

In the above construction, a plurality of cooling headers 12 are arranged in the direction of a vertical path in which the strip 11 is conveyed.

Water can be used as the cooling medium 14. In this case, water includes pure water, softened water, hard water, filtered water, clean water, fresh water, raw water and water into which an antioxidant is added. Also, gas can be used as the cooling medium 14. In this case, the gas includes atmospheric gas used in a furnace, inert gas such as argon, nonoxidizing atmospheric gas such as nitrogen, atmosphere or a mixed gas into which the above gases are mixed. The above are singly used, or alternatively the above are used in combination with each other.

As a special example of the cooling medium of liquid, there is proposed a method in which an organic solvent, the boiling point of which is high, or salt is used instead of water. In this connection, the methods of spray cooling and mist cooling are respectively defined as follows in this specification. When a strip is cooled by directly blowing a cooling medium against the strip, liquid such as water is singly used as the cooling medium. This cooling method is defined as spray cooling. When a strip is cooled by directly blowing a cooling medium against the strip, a mixture in which liquid such as water and gas are mixed with each other is used. This cooling method is defined as mist cooling.

When a strip passes in a vertical passage, it is warped in the longitudinal and the width direction because various stresses are given to the strip. FIG. 3 is a view showing a model of the cooling state in which a cooling medium is directly blown by the conventional means against the strip 11 which has been warped in the width direction as shown in FIG. 2.

When a cooling medium containing liquid such as water is directly blown against the strip 11 which has been warped in the width direction, the cooling medium 17 blown against the strip 11 locally concentrates at the center of the strip, in the width direction, on the concave side.

Further, in the vertical passage, the cooling medium which has concentrated upon the center of the strip in the width direction flows down along the strip in the longitudinal direction. Therefore, the center 15 of the strip in the width direction is overcooled.

FIG. 4 is a diagram showing an example of the temperature distribution in the width direction of the strip on the delivery side of the cooling zone in the case of mist cooling of the strip in the vertical passage of the conventional cooling method. As shown in the diagram, due to the phenomenon described before, the center 15 of the strip in the width direction is overcooled. Also, the edge portions of the strip in the width direction are overcooled.

In the edge portions 16 of the strip in the width direction, heat is removed from not only the back surface of the strip but also the edge surfaces of the strip. For this reason, the edge portions 16 of the strip in the width direction are overcooled.

When a strip is heat-treated in the continuous strip heat-treating line, various heat cycles are used according to the material of the strip to be manufactured. In general, as shown in FIG. 5, when a mild steel strip is manufactured, the following heat cycle is used. After the strip is heated to 700 to 900° C. and soaked, it is cooled to 240 to 450° C. in the first cooling zone 5 for over-aging, and then the strip is cooled to the room temperature in the second cooling zone 8.

When the strip is cooled in the respective cooling zones as described above, a temperature of the strip scatters. Due to the scatter of temperature, a material quality of the strip scatters.

Recently, there is an increasing demand of a so-called high-tension material. When a high-tension material is heat-treated in the above heat-treating line, the following problems may be encountered.

In the case of heat-treatment of the high-tension material, the temperature tends to vary in the width direction of the strip on the delivery side of the first quenching zone. Due to the above temperature variation, the mechanical strength of the strip varies, so that the material of the strip in the width direction varies. In order to solve the above problems, this defective portion of the strip caused in the mild steel strip or the high-tension material is conventionally removed by cutting off the defective portion on the delivery side of the continuous strip heat-treating line or in the finishing line.

However, the above method in which the defective portion is removed from the strip is disadvantageous as follows. The frequency of the occurrence of the defective portion scatters greatly. Therefore, it is necessary to manufacture the strip, the quantity of which is larger than a predetermined value. As a result, the production control becomes complicated. Further, it takes time and labor to detect the defective portion of the strip. When the defective portion is removed from the strip, the yield is deteriorated, and further the additional manufacturing process such as the finishing line, etc. is required. Therefore, the manufacturing cost is increased.

DISCLOSURE OF THE INVENTION

The present invention is to provide a cooling system for cooling a strip uniformly in the width direction of the strip in a continuous strip heat-treating process by which the variation of temperature of the strip in the width direction can be reduced in the first quenching zone 5 and the second cooling zone 8.

It is an object of the present invention to provide a cooling system by which the variation of temperature of a warped strip in the width direction can be reduced in a vertical path of the cooling region.

It is another object of the present invention to provide a cooling system by which the difference in temperature of a strip can be reduced especially when the strip is cooled to a low temperature zone.

It is still another object of the present invention to provide a cooling system by which a flow rate of the cooling medium can be controlled at each position on the strip in the width direction.

It is possible to accomplish the above objects by the following cooling system.

In the exemplary continuous strip heat-treating process shown in FIG. 1, there is provided a cooling system in which a heated strip is cooled to a predetermined temperature while the strip is moved in the vertical direction. The cooling system is composed of a plurality of rows of cooling nozzles in which a plurality of cooling nozzles are arranged in the width direction of the strip. The plurality of rows of cooling nozzles are arranged in the vertical direction of movement of the strip.

In the above arrangement, the cooling nozzle is characterized as follows. A center line of a jet of the cooling medium, which is jetted out from the cooling nozzle, crosses the strip at a point. An angle formed between this center line of the jet of the cooling medium and a normal line at this point on the strip is determined to be a constant angle selected from an angle range of 2 to 45°. The cooling nozzle is arranged being inclined by this constant angle to the edge portion of the strip.

Another embodiment is described below. In order to radially arrange the center lines of the jets of the cooling medium jetted out from the cooling nozzles, the cooling nozzles are successively arranged in the width direction of the strip in such a manner that the inclination angle of one cooling nozzle is larger than that of the other cooling nozzle located adjacent to the above nozzle on the center side of the strip.

When the cooling nozzles are arranged being successively inclined in the above manner, no cooling medium concentrates upon the center of the strip. Therefore, the strip can be cooled uniformly in the width direction of the strip. Accordingly, the variation of material of the strip can be reduced, and the quality of the strip can be enhanced.

BEST MODE FOR CARRYING OUT THE INVENTION

Referring to the most preferred embodiment, the present invention will be explained in detail as follows.

Figure 6:
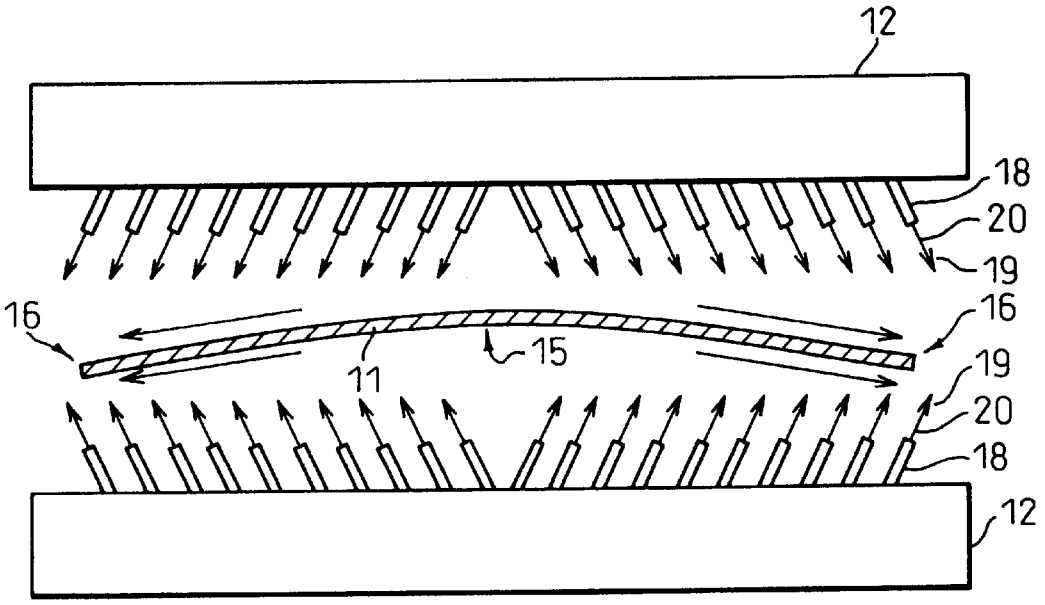
FIG. 6 is a plan view showing an outline of the embodiment in which the inclines cooling nozzles of the present invention are arranged.
Figure 7:
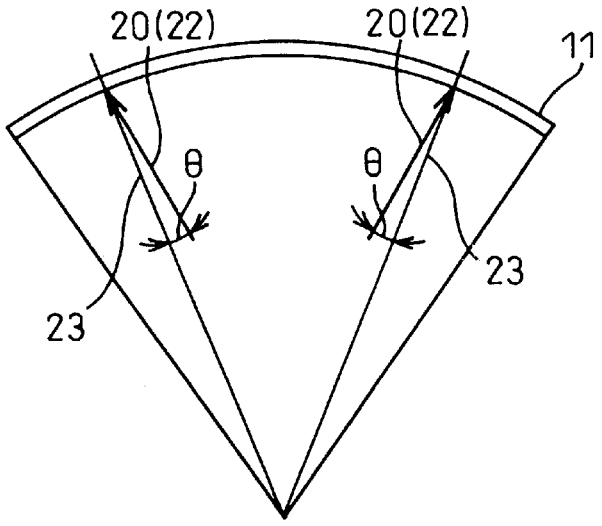
FIG. 7 is a schematic illustration for explaining an inclination angle formed between a center line of a jet of the cooling medium and a straight line perpendicular to a strip at a position where the jet of the cooling medium collides with the strip.

FIG. 6 is a plan view showing an outline of the cooling system which is an embodiment of the present invention. This view shows a state in which the cooling medium is jetted out.

Figure 1:
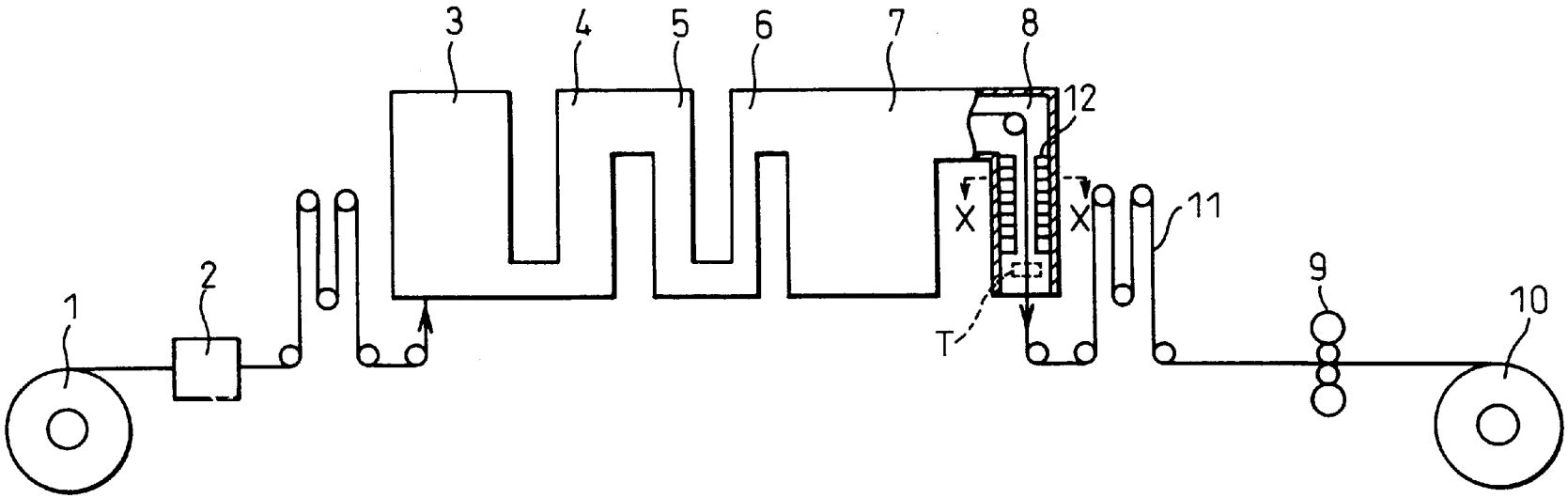
FIG. 1 PRIOR ART
FIG. 1 is a partially sectional front view showing an outline of the arrangement of an example of the conventional continuous strip heat treating apparatus.
Figure 2:
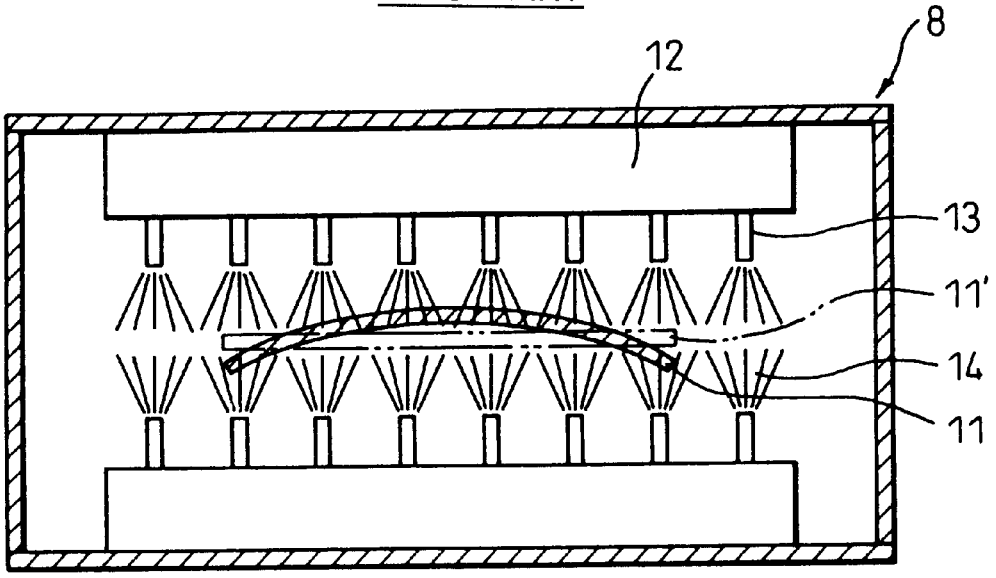
FIG. 2 PRIOR ART
FIG. 2 is a cross-sectional view taken on line X—X in FIG. 1.
Figure 3:
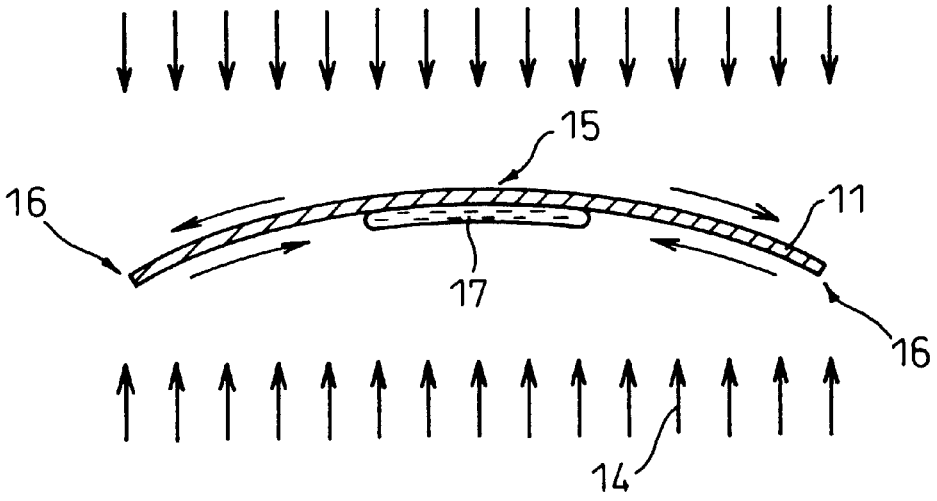
FIG. 3 PRIOR ART
FIG. 3 is a schematic illustration showing a model of the state of cooling a strip in FIG. 2.

For example, the cooling system of the present invention is shown in the secondary cooling zone 8 in FIG. 1. In the secondary cooling zone 8, there are provided a plurality of cooling headers 12 which are arranged in the direction of movement of a strip 11 moving in the vertical direction, and these cooling headers 12 are located close to both surfaces of the strip 11. As shown in FIG. 6, in each cooling header 12, there are provided cooling nozzles 18 which are inclined by a predetermined angle θ being directed from the center 15 of the strip to the edge portions 16, 16 in the width direction of the strip.

In this case, the angle θ is defined as an angle formed between the center line 20 of the jet of the cooling medium and the normal line 23 at a position on the strip where the center line 20 of the jet crosses the strip 11.

The angle θ is a constant value in a range from 2° to 45°. The range of the angle θ is determined according to the results of the following experiments.

FIGS. 8A to 8D are diagrams showing the results of experiments in which the strips were cooled by means of mist cooling conducted by water, wherein material of the strip was a common mild steel, thickness of the strip was 1.6 mm, width of the strip was 920 mm, and the line speed was 170 m/min. The strips were cooled in a cooling zone in which cooling nozzles were arranged in a vertical passage, and the inclination angles of all cooling nozzles were the same, and the value of the angle was changed by 1° in a range from 0 to 70°. The distribution of temperature was measured at each angle of the cooling nozzle.

FIGS. 8A to 8D are diagrams showing the results of the above experiments in the form of a relation between the nozzle inclination angle and the average difference of the strip temperature in the width direction.

Figure 8A:
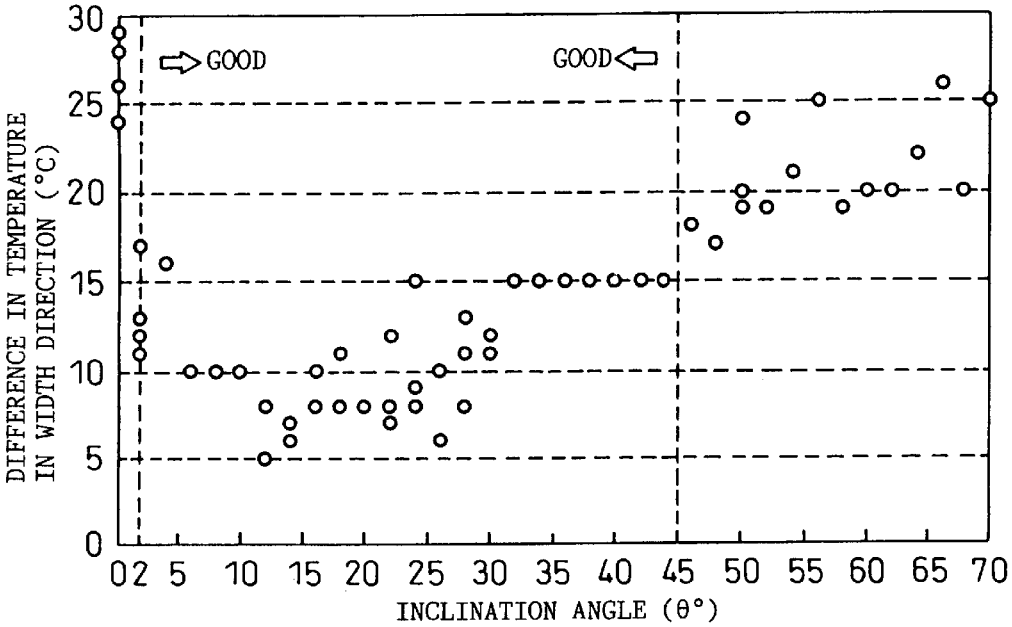
FIGS. 8A 8B, 8C and 8D are diagrams showing relations between the inclination angle of the cooling nozzle and the difference of temperature in the width direction of a strip.

FIG. 8A is a diagram showing the result of an experiment made under the condition that the cooling start temperature was 720° C. and the cooling completion temperature was 240° C.

For example, a cooling medium of water, the total quantity of which was 360 $m^3$/Hr, was jetted out from the cooling nozzles inclined by the inclination angle of 40°, so that the strip was cooled. After that, temperatures at 29 positions aligned in the width direction of the strip were measured, and an average value of the temperature differences was displayed on the diagram.

Figure 8B:
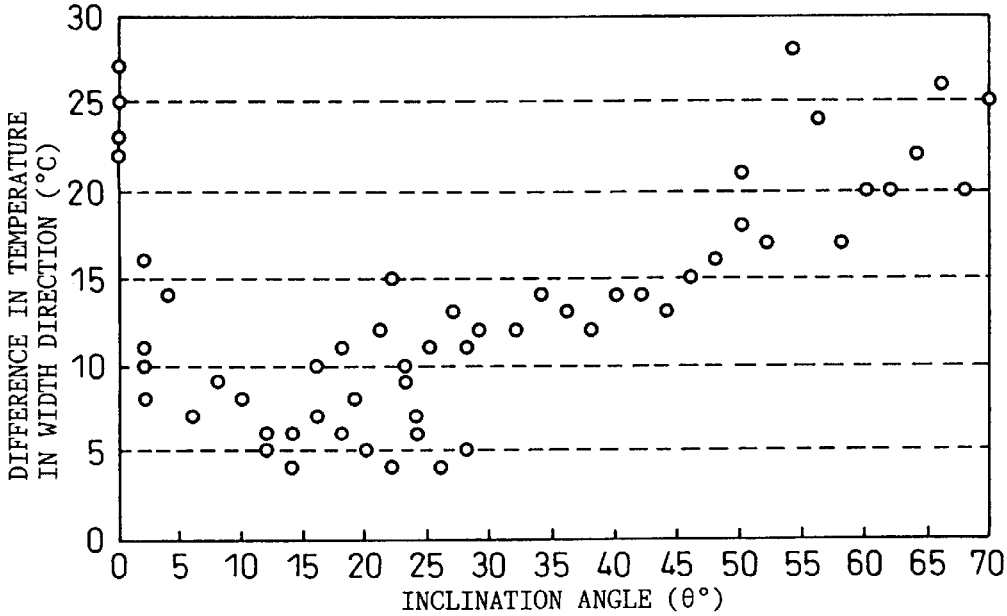

FIG. 8B is a diagram showing the result of an experiment made under the condition that the cooling start temperature was 720° C. and the cooling completion temperature was 420° C. The specification of the nozzles was the same as that of the nozzles shown in FIG. 8A, and a strip was cooled by these nozzles, and differences in temperatures in the width direction of the strip were found and an average value of the differences was displayed on the diagram.

Figure 8C:
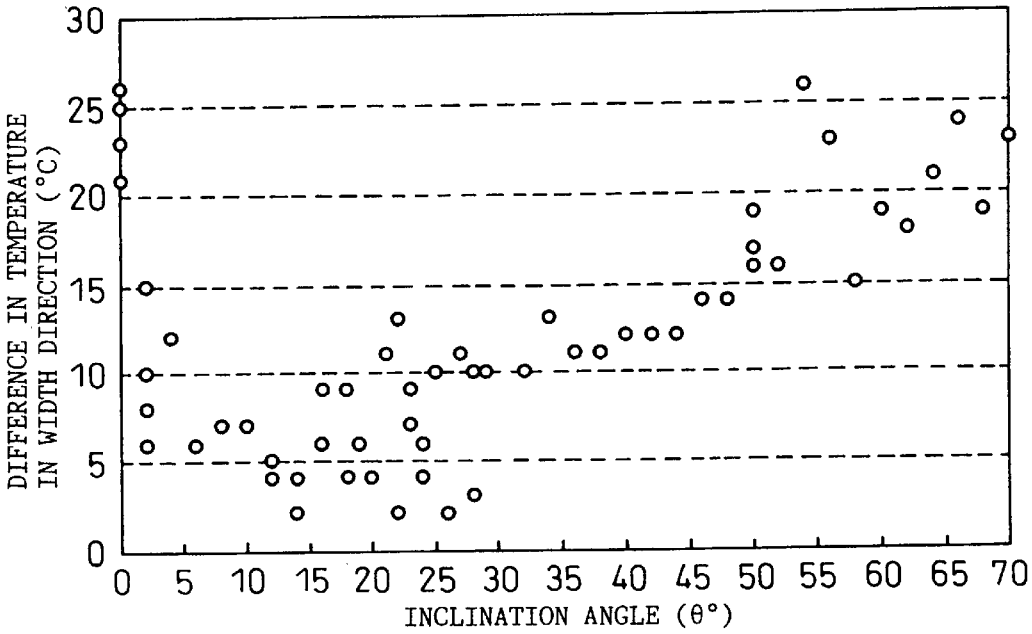

FIG. 8C is a diagram showing the result of an experiment made under the condition that the cooling start temperature was 360° C. and the cooling completion temperature was 100° C. The specification of the nozzles was the same as that of the nozzles shown in FIG. 8A, and a strip was cooled by these nozzles, and differences in temperature in the width direction of the strip were found and the average of the differences was displayed on the diagram.

Figure 8D:
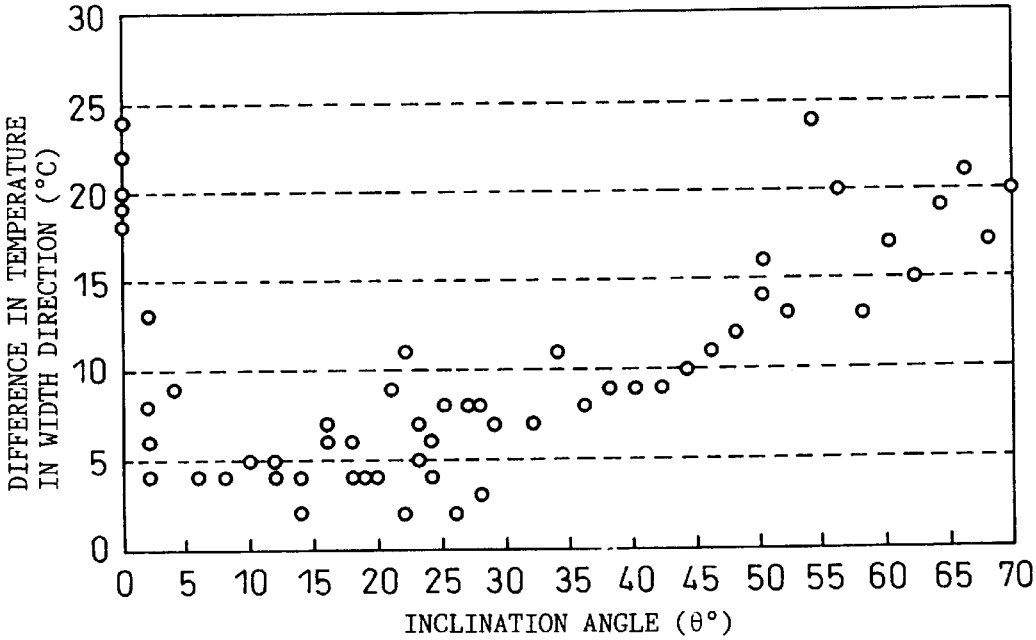

FIG. 8D is a diagram showing the result of an experiment made under the condition that the cooling start temperature was 360° C. and the cooling completion temperature was 220° C. The specification of the nozzles was the same as that of the nozzles shown in FIG. 8C, and a strip was cooled by these nozzles, and the differences in temperature in the width direction of the strip were found and the average of the differences was displayed on the diagram.

As a result of the experiment, the following can be found. When the conventional cooling nozzles, the inclination angle of which was 0, were used, the difference in temperature was approximately not lower than 20° C., however, when the nozzles, the inclination angle of which was 2 to 45°, were used, the difference in temperature was not higher than 15° C. irrespective of the cooling completion temperature, and especially when the nozzles, the inclination angle of which was 5 to 30°, were used, the difference in temperature was not higher than 10° C.

Due to the foregoing, the following can be found. When the cooling nozzles were arranged being inclined by a constant angle, the effective inclination angle was 2 to 45°.

However, as described later, the difference in temperature of the edge portion of the strip in the width direction is larger than that of the center of the strip. In the above case, no problems are caused when the strip is made of mild steel, however, problems may be caused when the strip is made of material of high tension material because variations may be caused in the material of the edge portions.

In this connection, in a range of the cooling header, the distance from the center to which is approximately not larger than 20 mm, the degree of bend of the strip is low. Therefore, the inclination angle of the nozzle may be determined to be 0° in this range of the cooling header.

Next, referring to FIG. 10, another embodiment of the present invention will be explained below. In this embodiment, the cooling nozzles 20 are arranged as follows. The cooling medium jet directions of the cooling nozzles 20 are directed toward the end portions 16, 16 of the strip 11 in the width direction. The inclination angle $\theta_i$ of the cooling nozzle $\mathbf{20}_i$ is larger than the inclination angle $\theta_{i-1}$ of the cooling nozzle $\mathbf{20}_{i-1}$ arranged adjacent to the cooling nozzle $\mathbf{20}_i$ on the center 15 side of the strip. Further, the inclination angle $\theta_{i-1}$ is larger than the inclination angle $\theta_{i-2}$. While this relation of the inclination angle is successively maintained in the above manner, the cooling nozzles 20 are arranged in the width direction of the strip.

According to the arrangement described above, the center lines of the jets of the cooling nozzles are radially arranged around the center of warp of the strip.

Figure 11:
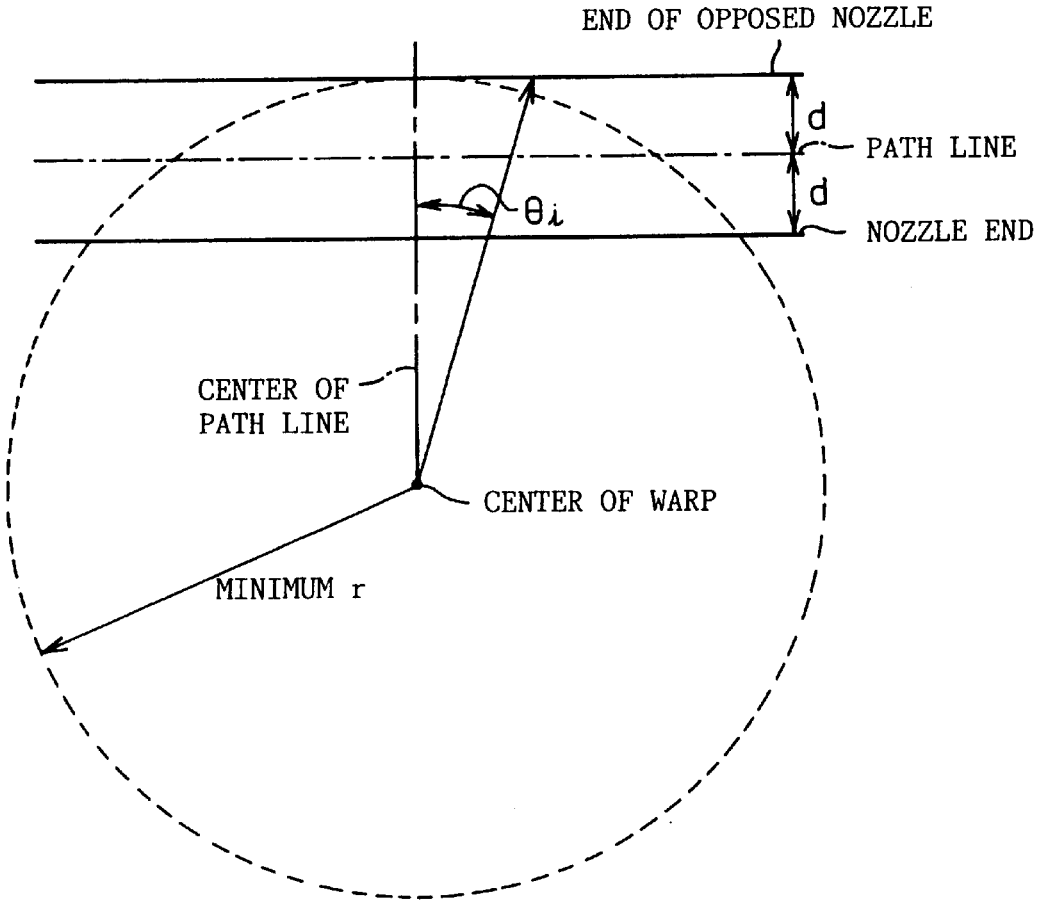
FIG. 11 is a view showing the primary components used in an equation to find the inclination angle of the cooling nozzle in the embodiment shown in FIG. 10.

In this case, the pitch of the cooling nozzles and the difference in the inclination angles of the nozzles located adjacent to each other are not particularly restricted, however, the angle $\theta_i$ may be found by the following equation (1).

$$\theta_i = \tan^{-1}|b \pm a \times i|/r - K \quad (1)$$

where K: $0 < K \leqq 2d$ a: Pitch of the cooling nozzles b: Amount of offset of the central nozzle from the line center r: Minimum radius of curvature of warp in the width direction of a strip d: Distance from the nozzle end to the path line $\theta_i$: Inclination angle of the i-th nozzle when it is counted from the central nozzle Relationships among the components expressed in the above equation (1) are shown in FIG. 11.

Value "a" is determined from the viewpoint of preventing the interference of jets of the cooling nozzles arranged adjacent to each other and also from the viewpoint of providing an appropriate density of volume of water jetted out onto the strip. Value "b" is determined by a physical tie-in between the value "a", the nozzles and the piping. However, in the present invention the value "b" is not particularly restricted. Value "r" is the minimum radius of curvature of warp in the width direction of a strip. This value "r" is changed by the thickness and material of the strip and also by the line characteristic. Therefore, the value "r" may be determined by the result of a threading test. Accordingly, the value "r" is not particularly restricted in the present invention. Value "k" is the maximum value of the distance from the strip to the nozzle. As shown in FIG. 11, the value "k" is 2d at most. Accordingly, when the value $\theta_i$ is calculated under the condition k=2d so that the nozzles can be arranged, it becomes possible to exhibit a positive effect. On the other hand, even when $\theta_i$ is calculated under the condition k=2d and the nozzle arrangement is designed, it becomes difficult to manufacture the nozzles because the value θ is too high. In the above case, even when the nozzle arrangement is designed again using the values satisfying the inequality of k<2d, the same effect can be provided for example, by using a strip threading position adjusting device such as a pushing roller. For the reasons described above, the value "k" is determined in a range satisfying the inequality of $0<k\leqq 2d$.

When the cooling nozzles are arranged in the above manner, the center lines 22 of the jets are inclined toward the edge portions 16, 16 of the strip by the inclination angle θ at all positions where the jets collide with the strip except for the center 15 of the strip. Therefore, no cooling medium 21, blown against the strip 11, concentrates at the center 15 of the strip.

Accordingly, in the same manner as that of the embodiment shown in FIG. 6, the difference in temperature in the width direction of the strip can be controlled to be not higher than 15° C. after the strip has been cooled.

As described above, when the cooling nozzles are arranged being inclined by a constant inclination angle as shown in FIG. 6, the following problems may be encountered. When this angle is too small, all the cooling medium blown against the strip in a range from a certain position to the edge portion of the strip flows inside the strip. Therefore, a difference in temperature of the strip is caused. On the contrary, when the inclination angle is too large, a portion against which the cooling medium is not blown is generated in a portion close to the center of the strip. Due to the foregoing, a difference in temperature of the strip is also caused.

In any case, when the cooling nozzles are arranged at a constant inclination angle, the difference in temperature is necessarily caused for the above reasons. Therefore, it is necessary to find out a relationship between the inclination angle and the difference in temperature and determine a range of angles in which the temperature difference can be reduced as small as possible.

Figure 10:
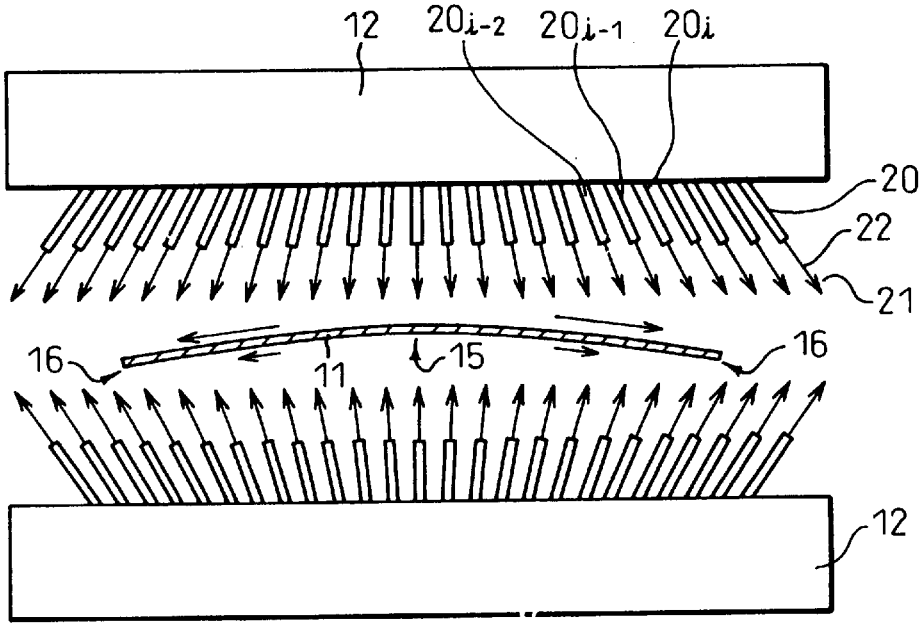
FIG. 10 is a plan view showing an outline of another embodiment in which the inclined nozzles of the present invention are arranged.

On the other hand, in the case where the cooling nozzles are radially arranged as shown in FIG. 10, the inclination angles of the cooling nozzles are decreased in a portion close to the center of the strip. Accordingly, no problems are caused because the cooling medium collides with this portion close to the center of the strip. The inclination angles of the cooling nozzles arranged at the edge portion of the strip are increased in such a manner that the closer to the edge portion the cooling nozzles are arranged, the larger the inclination angles are increased. Further, the cooling nozzles are inclined from the normal line of the strip toward the edge portion of the strip. Therefore, unlike the edge portion of the strip described before, the center portion of the strip is not overcooled in this embodiment. Accordingly, in the radial arrangement of the cooling nozzles, it is unnecessary to restrict a range of the inclination angles of the cooling nozzles. Further, it is possible to stably maintain a difference in temperature in the width direction of the strip to be not more than 10° C. as described later. Therefore, from the viewpoint of temperature distribution, this embodiment is superior to the aforementioned embodiment in which the cooling nozzles are arranged at a constant inclination angle.

In this connection, in order to prevent the center of the strip from being overcooled on the delivery side of the cooling zone, it is effective to provide the following means. There is provided a measuring apparatus by which a warp (radius of curvature) of a strip in the width direction is measured. The cooling nozzles are composed in such a manner that the inclination angles of the nozzles can be changed. The inclination angles of the nozzles are controlled in accordance with the warp of the strip in the width direction so that the cooling medium can be always blown onto the edge portion side of the strip. Due to the above means, overcooling of the center of the strip in the width direction can be reduced.

When the cooling medium locally concentrates and flows down coming onto contact with the strip, the strip is locally cooled. This influence of local cooling can be reduced when the surface temperature of the strip is high. Therefore, it is effective to adopt a method of "up-path" in which the strip is threaded upward in the cooling zone.

Next, referring to FIGS. 13 and 15, an embodiment of the present invention will be explained in which a row of cooling nozzles are divided. In the following embodiment, the row of cooling nozzles are divided by means of dividing the cooling header. However, it should be noted that the method of dividing the row of cooling nozzles is not limited to the specific embodiment.

As described before, when the strip is cooled in accordance with the embodiments shown in FIGS. 6 and 10, it is possible to decrease the difference in temperature to be not higher than 15° C. and preferably to be not higher than 10° C. However, when a detailed investigation is made into the temperature distributions of the above embodiments, the following problems may be encountered. In the above embodiments, it is possible to evade the occurrence of overcooling of the center of the strip caused when the cooling medium flows down coming into contact with the center of the strip which is caused when the cooling medium concentrates upon the center. However, it is impossible to evade the occurrence of overcooling of the edge portions of the strip in the width direction. Therefore, the temperatures of the edge portions of the strip are lower than the temperature of the center of the strip.

Figure 13:
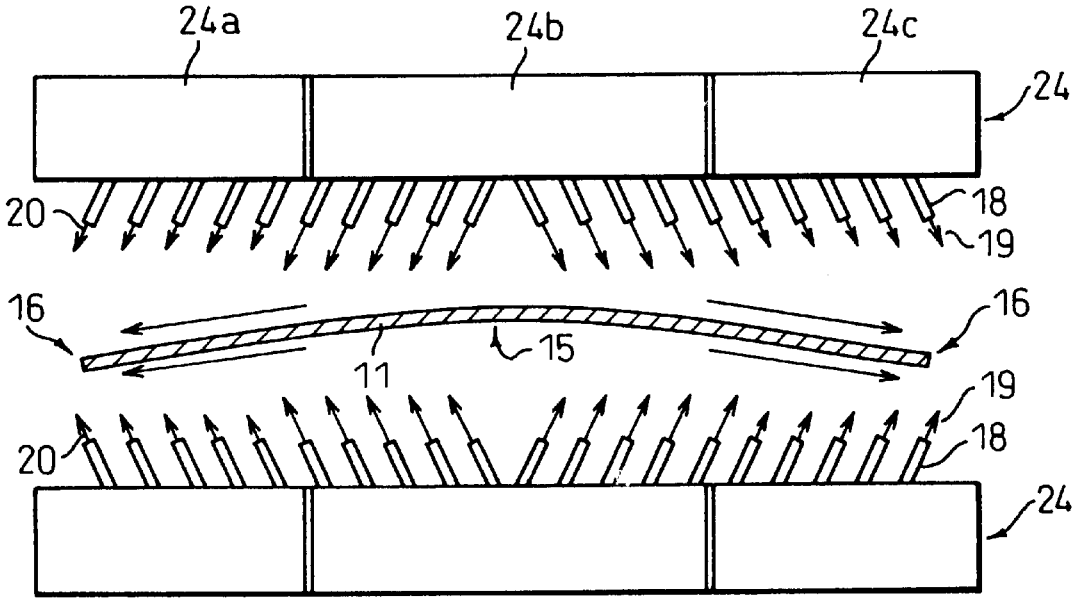
FIG. 13 is a plan view showing an outline of the embodiment of the present invention in which a row of cooling nozzles are divided.
Figure 15:
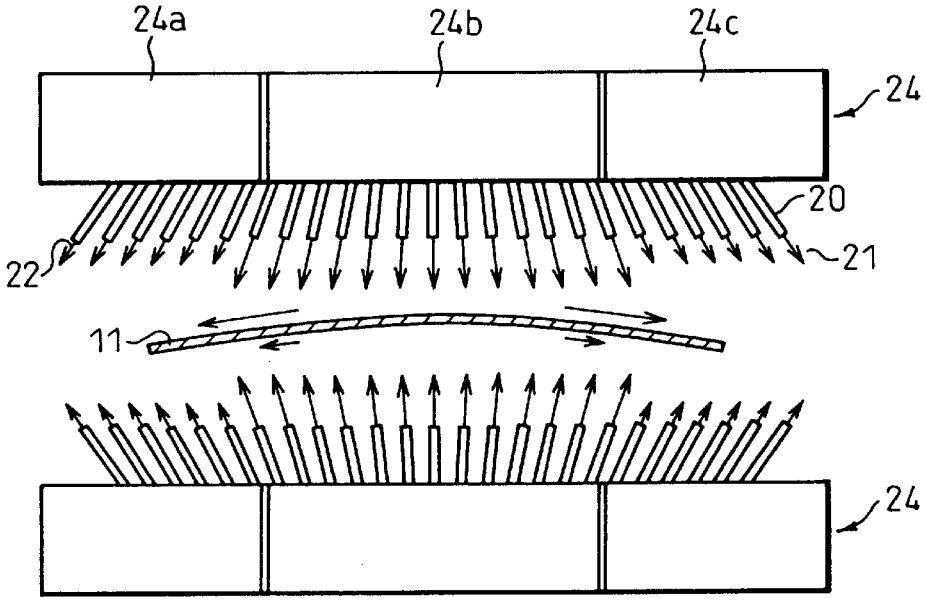
FIG. 15 is a view showing another embodiment of the divided row of cooling nozzles of the present invention.

In order to solve the above problems, as shown in FIGS. 13 and 15, for example, the cooling header 24 is divided into three portions 24*a*, 24*b*, 24*c* in the width direction of the strip. A plurality of cooling nozzles in each header are formed into independent groups, and a quantity of cooling medium is controlled for each independent group.

As a controlling means, in order to prevent the edge portions of the strip from being overcooled, which is residual in the embodiments shown in FIGS. 6 and 10, the rate of flow of the cooling medium 19, 21 flowing out from the header 24*a*, 24*c* is decreased to be lower than the rate of flow of the cooling medium flowing out from the header 24*b*.

When the quantity of the cooling medium fed to both edge portions of the strip in the width direction is adjusted as described above, it becomes possible to prevent both edge portions of the strip from being overcooled, and the strip can be cooled substantially uniformly in the width direction.

In general, in the continuous strip heat treating line, the width of the strip to be heat-treated is not necessarily the same, that is, strips of different widths are continuously heat-treated. Therefore, positions of the edge portions of the strip in the width direction are changed in accordance with the width of the strip to be heat-treated. For this reason, it is preferable that the number of the divided headers is large.

Of course, so far as the equipment investment permits, the rate of flow of the cooling medium may be controlled for each nozzle. In the case of spray cooling, the structure of the cooling pipe and nozzle is simple. Therefore, it is easy to increase the number of the divided cooling headers according to the width of strip to be heat-treated.

Figure 14:
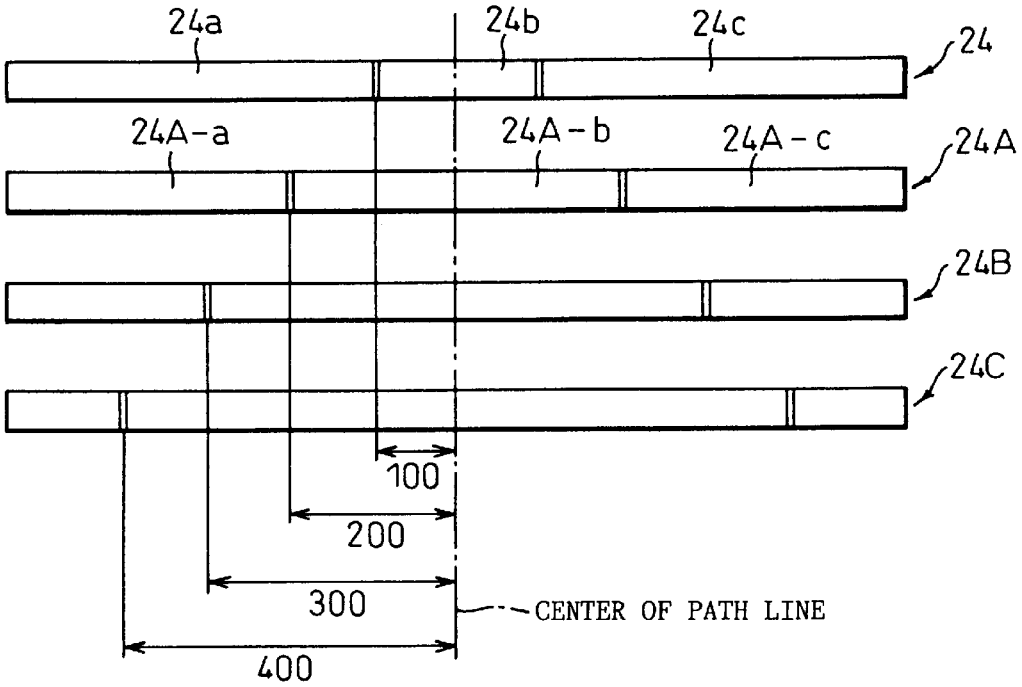
FIG. 14 is a view showing an example of the position of division of the row of cooling nozzles of the present invention.

On the other hand, when the number of the divided cooling headers is increased too large, controlling the flow rate of the cooling medium becomes complicated. Accordingly, the cooling header is divided into a plurality of controlling blocks described as follows. As shown in FIG. 14, a plurality of cooling headers 24*a*, 24*c*, the dividing positions in the width direction of which are the same, are made to be one control block. The dividing positions of the cooling headers 24, 24A, 24B, 24C are arranged in the advancing direction of the strip so that the dividing positions of the cooling headers can be different from each other by a distance not less than 50 mm. In the structure shown in FIG. 14, the dividing positions of the cooling headers are different from each other by a distance 100 mm.

Due to the above arrangement, even if the number of the divisions of a single cooling header is small, when the controlling blocks are appropriately selected, it becomes possible to heat-treat the strips of various widths. As a result, the number of the divisions of the cooling header can be decreased, and the equipment cost can be reduced. Further, controlling the rate of flow of the cooling medium for each divided cooling header can be simplified.

In order to reduce the difference in temperature in the width direction of the strip, when a difference of the rate of flow of the cooling medium for each divided cooling header is extended, the capacity of reducing the difference in temperature in the width direction of the strip by a single cooling header can be enhanced.

When the strip is cooled in the cooling apparatus of the present invention by means of mist-cooling, it becomes possible to extend the difference in the rate of flow of the cooling medium for each divided cooling header. As a result, it is possible to apply the present invention to an established apparatus easily, that is, even if the established apparatus is remodeled in a restricted range, the present invention can be applied. In the case where the cooling apparatus is newly manufactured, it is possible to decrease the number of divided headers. Accordingly, the equipment cost can be reduced, and further the rate of flow of the cooling medium can be easily controlled for each divided cooling header.

In general, for each strip coil to be heat-treated, or even in the same strip coil to be heat-treated, the variation of temperature (the difference in temperature) changes in the width direction of the strip on the delivery side of the cooling zone. In order to reduce the influence of the above variation in temperature, it is preferable to adopt the following means for controlling a rate of flow of the cooling medium. There is provided a strip width direction temperature measuring device (represented by the reference character T in FIG. 1) in the middle of the cooling zone in the longitudinal direction or on the delivery side of the cooling zone. The temperature distribution in the width direction of the strip is measured by this temperature measuring device. The rate of flow of the cooling medium in each divided cooling header is appropriately controlled by a flow rate controlling unit provided outside the cooling system of a continuous annealing apparatus in accordance with the temperature distribution measured by the above temperature measuring device.

From the viewpoint of enhancing the stability of the control system, it is preferable that the flow rate control period to control the flow rate of the cooling medium can be arbitrarily changed in accordance with the fluctuation frequency of the variation in the temperature (the difference in temperature) of the strip in the width direction on the delivery side of the cooling zone.

The above explanations are made in the case of applying the present invention to the continuous annealing process. However, it is possible to apply the present invention to another apparatus such as an apparatus for melt galvanizing in which heat-treatment is conducted on a strip.

EXAMPLES

In the following examples, a row of cooling nozzles are divided by the method of dividing the cooling header.

Example 1

A strip made of common mild steel, the thickness of which was 1.6 mm and the width of which was 920 mm, was cooled by water of mist cooling under the condition that the line speed was 170 m/min. In the cooling apparatus, there were provided 45 cooling headers. In this case, the number of cooling headers was the number of cooling headers arranged on one side of the strip. Therefore, the number of cooling headers arranged on both sides of the strip was 90. The inclination angle of each cooling nozzle was set at 35° which was maintained constant.

Figure 9:
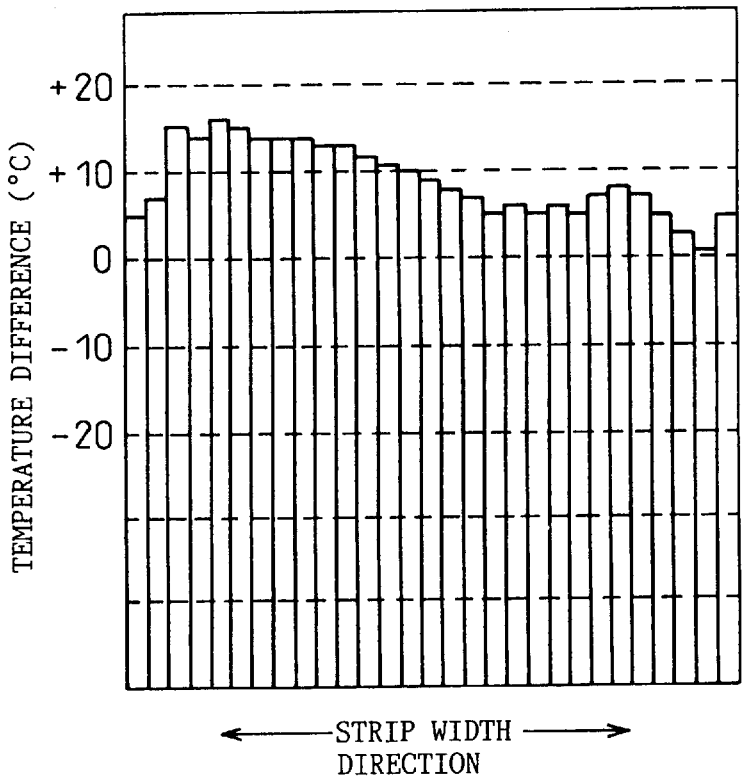
FIG. 9 is a diagram showing a temperature distribution in the width direction of a strip when the strip is cooled in the embodiment shown in FIG. 6.

When the strip was cooled from 720° C. to 240° C. under the above condition, the total quantity of cooling water was 360 $m^3$/Hr. As shown in FIG. 9, the difference in temperature in the width direction of the strip on the delivery side of cooling was controlled to be not higher than 15° C., however, both edge portions in the width direction of the strip were especially overcooled, and the temperatures were lowered.

Figure 4:
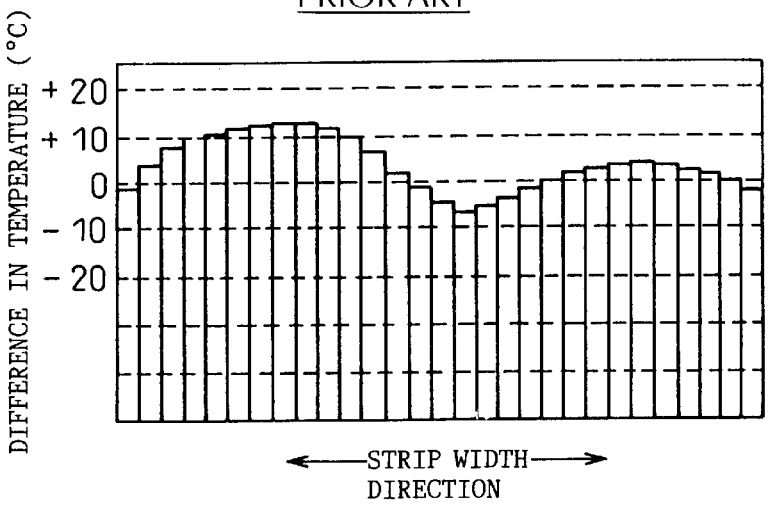
FIG. 4 PRIOR ART
FIG. 4 is a diagram showing a temperature distribution of a strip in the width direction on the delivery side of a cooling zone, wherein the strip is cooled in the cooling state shown in FIG. 3.
Figure 5:
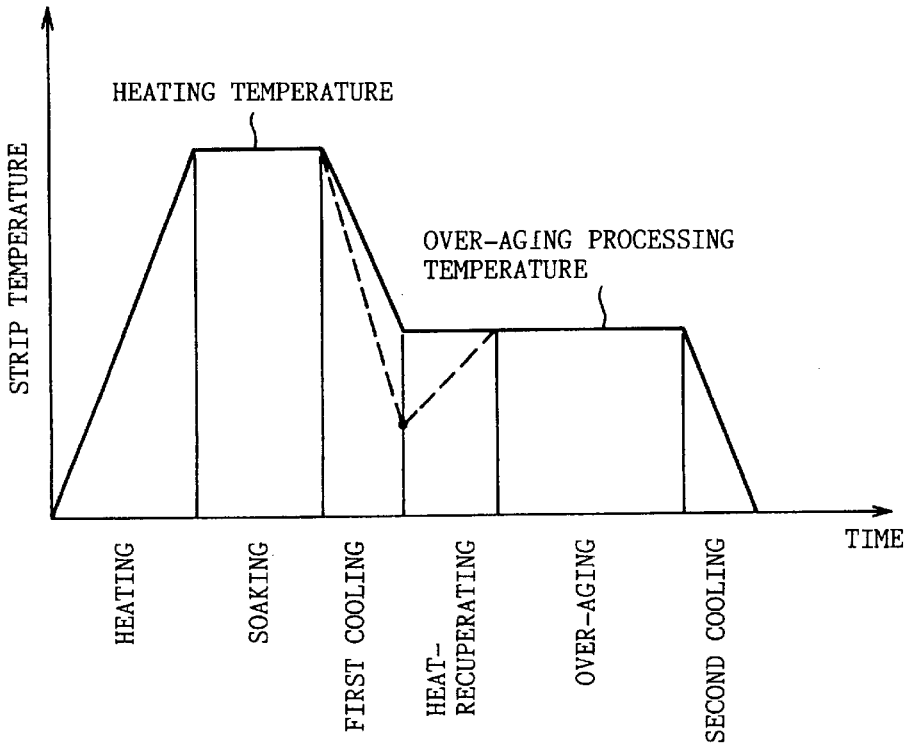
FIG. 5 is a diagram showing a heat cycle in which a common mild steel strip or high-tension material is heat-treated.

For the purpose of comparison, in FIG. 4, there is shown a result of experiment in which the conventional nozzles, the inclination angles of which were 0°, were used. When the result of this example is compared with the result shown in FIG. 4, it is clear that the center of the strip was prevented from overcooling.

Example 2

In this example, the cooling nozzles were arranged radially as shown in FIG. 10 and other components for cooling were the same as those of Example 1.

In this example, the cooling header was composed as follows. The inclination angle of one cooling nozzle arranged closest to the center of the cooling header was set at 0°. The nozzles arranged on both sides adjacent to the above nozzle arranged closest to the center were inclined to both edge portions in the width direction of the strip under the condition that the inclination angles of the nozzles were set at 0.1°. The nozzles adjacent to the above nozzles were inclined under the condition that the angle 0.5° was added to the inclination angles of the nozzles. Successively, the angle 0.5° was added to the inclination angles of the adjacent nozzles which were inclined to both edge portions in the width direction of the strip. In this way, all center lines of the jets of the cooling nozzles were radially arranged to form a cooling header.

The pitch of the cooling nozzles was maintained to be a constant value 50 mm.

Concerning the strip cooling condition and the total quantity of cooling water, Example 2 was the same as Example 1.

Figure 12:
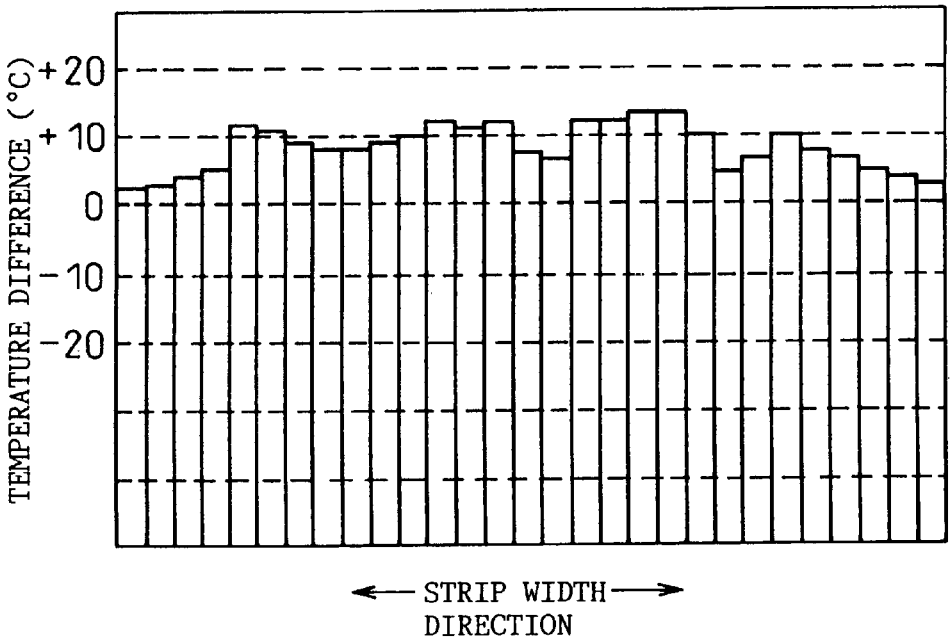
FIG. 12 is a diagram showing a distribution of temperature of a strip in the width direction when the strip is cooled in the embodiment shown in FIG. 10.

The temperature distribution in the width direction of the strip was measured on the delivery side of the cooling system, and the differences in temperature are shown in FIG. 12. As can be seen in FIG. 12, the differences in temperature were controlled in a temperature range not higher than 10° C. However, both edge portions in the width direction of the strip were overcooled, so that the temperatures of both edge portions were somewhat lowered. However, no variations of material were caused in the width direction of the strip.

Example 3

A strip made of high-tension steel, the thickness of which was 1.0 mm and the width of which was 1120 mm, was cooled by mist of water cooling under the condition that the line speed was 240 m/min. In this example, there were provided 45 cooling headers, wherein each cooling header was divided into 5 portions. The cooling nozzles were radially arranged under the following conditions.

The pitch "a" of the cooling nozzles was 50 mm; the offset "b" of the central nozzle was 0 mm; the minimum radius "r" of curvature of the warp of the strip was 2200 mm; the distance "d" from the nozzle end to the path line was 145 mm; and "k" was 290 mm. Using these parameters, the inclination angle $\theta_i$ of the cooling nozzle was found by the equation (1). The number of the cooling nozzles was determined to be 30 per one cooling header. In this way, a row of cooling nozzles was arranged.

In this cooling system, the cooling operation was conducted as follows. The cooling start temperature of the strip was 670° C., the cooling completion temperature was 290° C., and the total quantity of cooling water was 350 $m^3$/Hr. The quantity of cooling water fed to the divided cooling header corresponding to the edge portion in the width direction of the strip was determined to be a value lower than the quantity of cooling water fed to other divided cooling headers by 10%.

Figure 16:
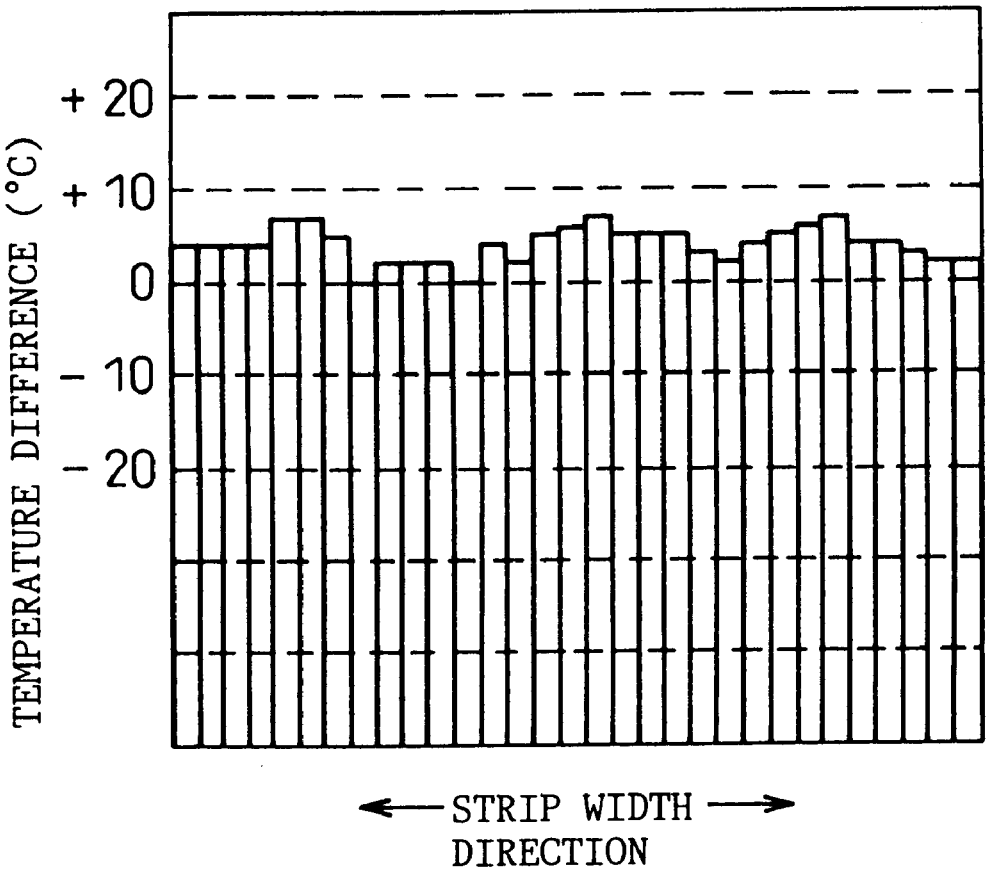
FIG. 16 is a diagram showing a distribution of temperature in the width direction of a strip when the strip is cooled in the embodiment shown in FIG. 15.

The temperature distribution in the width direction of the strip was measured on the delivery side of the cooling system, and the thus measured temperature distribution is shown in FIG. 16. As can be clearly seen in FIG. 16, the difference in temperature was controlled so as to be maintained in a range not higher than 8° C., and both edge portions in the width direction of the strip were prevented from being overcooled, so that the strip was substantially uniformly cooled in the width direction.

As a result, the material of the strip was made uniform in the width direction of the strip.

POSSIBILITY OF INDUSTRIAL USE

As described above, when a strip is cooled by the cooling nozzles of the present invention in the vertical path of the cooling system in which the strip is greatly warped in the width direction, the variation in temperature in the width direction of the strip can be greatly reduced. Accordingly, the material of the manufactured strip can be made uniform. Therefore, quality of the strip can be enhanced and the manufacturing yield can be remarkably improved. It is possible for the present invention to exhibit a great effect especially in an unstable cooling temperature region in which the temperature difference tends to be extended. Accordingly, the present invention can provide a great industrial effect.

What is claimed is:

1. A cooling system for cooling a strip in a vertical path of a continuous strip heat-treating process comprising:

a row of cooling nozzles disposed in said vertical path comprising a first group of cooling nozzles and a second group of cooling nozzles arranged in the width direction of the strip on a surface of a cooling header arranged closely opposed to a surface of the strip, with the strip having a first edge portion and an opposed second edge portion in the width direction of the strip wherein each cooling nozzle of the first group is inclined toward the first edge portion and each cooling nozzle of the second group is inclined toward the second edge portion by an inclination angle in such a manner that a center line of a jet of a cooling medium, which is jetted out from the cooling nozzle, is inclined with respect to a normal line at a position on the strip where the center line of the jet of the cooling medium crosses the strip.

2. A cooling system for cooling a strip in a vertical path of a continuous strip heat-treating process according to claim 1, wherein the inclination angles of the cooling nozzles are constant in a range from 2 to 45°.

3. A cooling system for cooling a strip in a vertical path of a continuous strip heat-treating process according to claim 1, wherein the cooling nozzles are successively arranged in the width direction of the strip in such a manner that the inclination angles of the cooling nozzles are made larger than the inclination angle of a cooling nozzle arranged adjacent to the above cooling nozzle on the center side in the width direction of the strip, so that the center lines of the jets of the cooling nozzles are radially arranged.

4. A cooling system for cooling a strip in a vertical path of a continuous strip heat-treating process according to claim 1, wherein the row of cooling nozzles is divided into a plurality of groups in the width direction of the strip, and a rate of flow of the cooling medium of each cooling nozzle group can be independently controlled.

5. A cooling system for cooling a strip in a vertical path of a continuous strip heat-treating process according to claim 4, wherein a plurality of rows of cooling nozzles divided in the width direction of the strip are arranged in an advancing direction of the strip, and a dividing position of each row of the cooling nozzles is shifted in the width direction of the strip by a distance of not less than 50 mm.

6. A cooling system for cooling a strip in a vertical path of a continuous strip heat-treating process according to claim 4, further comprising a temperature measuring device for measuring a temperature in the width direction of the strip arranged in the middle of the cooling system or on the delivery side of the cooling system.

7. A cooling system for cooling a strip in a vertical path of a continuous strip heat-treating process according to claim 6, further comprising a control unit for controlling a rate of flow of the cooling medium of each divided header in accordance with a temperature distribution in the width direction of the strip obtained when the temperature is measured by the temperature measuring device.

8. A cooling system for cooling a strip in a vertical path of a continuous strip heat-treating process according to claim 1, wherein each cooling nozzle is connected in fluid communication with a supply of liquid or a mixture of liquid and gas.

* * * * *